United States Patent [19]
Kadija et al.
[11] 4,169,774
[45] Oct. 2, 1979

[54] METHOD OF TREATING ASBESTOS DIAPHRAGMS FOR ELECTROLYTIC CELLS

[75] Inventors: Igor V. Kadija; Harshad M. Patel, both of Cleveland, Tenn.

[73] Assignee: Olin Corporation, New Haven, Conn.

[21] Appl. No.: 926,772

[22] Filed: Jul. 21, 1978

[51] Int. Cl.[2] ..... C25B 13/06; C25B 1/16; C25B 1/26

[52] U.S. Cl. ..... 204/98; 204/128; 204/295; 428/289; 428/443

[58] Field of Search ..... 204/98, 128, 295, 282; 428/289, 443

[56] References Cited

U.S. PATENT DOCUMENTS

| | | | |
|---|---|---|---|
| 984,915 | 2/1911 | Heltzen | 204/295 |
| 3,374,164 | 3/1968 | Balej et al. | 204/282 |
| 3,847,762 | 11/1974 | Strain | 204/98 |
| 3,979,276 | 9/1976 | Strain | 204/282 |
| 3,991,251 | 11/1976 | Foster et al. | 428/289 |

*Primary Examiner*—Arthur C. Prescott
*Attorney, Agent, or Firm*—James B. Haglind; Donald F. Clements

[57] ABSTRACT

Asbestos diaphragms in commercial cells for the electrolysis of brines are treated with a dispersion of an alkaline earth metal-containing silicate. Deposition of the dispersion within the diaphragm results in a decrease in hydrogen concentration in chlorine gas produced as well as an increase in current efficiency.

15 Claims, No Drawings

METHOD OF TREATING ASBESTOS DIAPHRAGMS FOR ELECTROLYTIC CELLS

This invention relates to diaphragm-type electrolytic cells for the electrolysis of aqueous salt solutions. More particularly, this invention relates to the treatment of porous asbestos diaphragms employed in electrolytic cells.

Commercial diaphragm cells for the electrolysis of alkali metal chloride brines to produce chlorine and alkali metal hydroxides employ porous asbestos diaphragms to separate the anode compartment of the cell from the cathode compartment. The asbestos diaphragm serves to prevent the intermixing of chlorine produced in the anode compartment with hydrogen and alkali metal hydroxide liquors produced in the cathode compartment. During the course of its operating life, the diaphragm may develop thin areas or holes which permit intermixing of products produced in the anode and cathode compartments.

Various methods have been previously employed in extending the life of porous asbestos diaphragms including the incorporation of various materials into the asbestos diaphragms during preparation or the addition of materials to the diaphragm during operation of the cell. Thus plastic materials have been employed as binding agents in preparing diaphragms as described in U.S. Pat. Nos. 2,860,100, issued to L. J. K. Krzyszkowski; 3,694,281, issued to J. Leduc; 3,928,166, issued to K. J. O'Leary et al and 3,980,613, issued to J. Bachot. Water soluble alkali metal silicates have been incorporated in asbestos diaphragms or added to the brine fed to the cell as described in U.S. Pat. Nos. 3,847,762 and 3,979,276, issued to F. Strain and 3,991,251, issued to R. T. Foster et al.

Where, however, the porous asbestos diaphragm permits increased hydrogen content in the anolyte, the above treatments are insufficient to reduce hydrogen content to an acceptable level.

It is an object of the present invention to provide a porous asbestos diaphragm having increased stability and a longer operational life.

Another object of the present invention is to provide a method of reinforcing a porous asbestos diaphragm during the operation of the cell.

These and other objects of the present invention are accomplished in a method for electrolyzing an alkali metal chloride brine in an electrolytic cell having an anode compartment containing said alkali metal chloride brine, a cathode compartment and a porous asbestos diaphragm separating said anode compartment from said cathode compartment which comprises:

(a) feeding particles of a magnesium-containing silicate to the anode compartment to form a dispersion of the magnesium-containing silicate in the brine, the magnesium-containing silicate having a mole ratio of magnesium to silicon of no greater than about 1:1, (b) contacting the porous asbestos diaphragm with the dispersion to deposit particles of the magnesium-containing silicate, and (c) conducting electrolysis in the electrolytic cell.

The term magnesium-containing silicate includes compositions having a mole ratio of magnesium (Mg) to silicon (Si) of no greater than about 1:1. Preferred ratios of Mg to Si are those of from about 1:1.5 to about 1:10. Where the magnesium-containing silicate also includes other metals, it is preferred that the ratio of metal cations to silicon are no greater than about 1:1.

Suitably employed in the treatment of porous asbestos diaphragms are particles of any non-fibrilic (non-fibrous) magnesium-containing silicate which are dispersible in an alkali metal chloride brine and which form a gel within the environment of a cell for the electrolysis of alkali metal chloride brines. Examples of dispersible substances include magnesium silicate as well as minerals such as sepiolite, meerschaum, palygorskite, attapulgite, augite, talc, and mixtures thereof. The dispersible magnesium-containing silicate should be capable of undergoing hydration when in contact with alkali metal chloride brines, alkali metal hydroxides and mixtures of alkali metal chlorides and alkali metal hydroxides. In addition to magnesium-containing silicates, mixtures of compounds may be employed which will combine to form a magnesium-containing silicate in situ. Suitable magnesium compounds include, for example, magnesia, magnesium acetate, magnesium aluminate, magnesium carbonate, magnesium chloride, magnesium hydroxide, magnesium oxide, magnesium peroxide, magnesite, periclase and dolomites. Silica-containing compounds which may be admixed include silica, sand, quartz, chalcedony, cristobalite and tripolite. Soluble silicates such as alkali metal silicates may also be used providing sufficient amounts of the magnesium compound is added to provide particles of a magnesium-containing silicate.

Preferred as magnesium-containing silicates are magnesium silicate, sepiolite, meerschaum, palygorskite, attapulgite and antigorite, with sepiolite and meerschaum being more preferred.

Where the magnesium-containing silicate is formed in situ, preferred magnesium compounds are magnesia, magnesium chloride and magnesium hydroxide.

Alkali metal chloride brines employed include, for example, sodium chloride and potassium chloride, where the brine concentrations are those employed in electrolytic processes for the production of chlorine and an alkali metal hydroxide.

In order to simplify the disclosure of the invention, it will be described hereinafter in terms of sepiolite, a preferred embodiment of the magnesium-containing silicate and sodium chloride as a preferred alkali metal chloride brine.

In the process of the present invention, particles of sepiolite are admixed with solutions of sodium chloride to form a dispersion. Suitable concentrations of sepiolite include those in the range of from about 1 to about 1,000, and preferably from about 50 to about 300 grams per liter of sodium chloride brine. Upon admixing the sepiolite particles with the brine, the sepiolite is dispersed throughout the brine solution. The dispersion is accomplished without the need of a dispersing agent. This dispersion is then fed to the anode compartment of the diaphragm cell. Any suitable amount of the dispersion may be added to the diaphragm cell. For example, amounts of dispersion added to the anolyte include those of from about 0.1 to about 10 percent by volume of anolyte brine.

When dispersed in the brine, the sepiolite particles are hydrated and swell to become gel-like. Upon swelling, the specific gravity of the gel-like particles approaches the specific gravity of the sodium chloride brine solution. As the brine contacts and passes through the porous diaphragm, these hydrated particles are readily deposited on and throughout the porous asbestos diaphragm. When deposited within the diaphragm, the gel-like particles of the magnesium-containing silicate blend with the gel-layer formed within the asbestos diaphragm. This deposition results in the renewal and reinforcement of the diaphragm and thus in the prevention or reduction of hydrogen molecules or hydroxide ions entering from the cathode compartment. Hydrogen concentration in the chlorine gas removed from the anode compartment is lowered substantially, the anode current efficiency with respect to chlorine production is increased, and chlorate formation is reduced.

As sepiolite particles are readily dispersed in alkali metal chloride brines, the particle size is not critical. Any suitable particle size may be used, for example, from about 0.05 to about 10 millimeters.

When using other magnesium-containing silicates, it may be desirable to use a dispersing agent to prevent the particles from settling out of the brine. Suitable dispersing agents include gums (natural, modified or synthetic) which when added, for example, in amounts of from about 0.1 to about 2 grams per liter of brine will effectively disperse the silicate particles. Alginates, xanthan gum or alkyl aryl polyether alcohols are suitable examples of dispersing agents.

It may also be desirable, when employing certain magnesium-containing silicates to select the particle size range to provide the hydrated gel-like particle having a specific gravity which approaches that of the brine solution. Suitable particle sizes of the magnesium-containing silicates are those in the range of from about 0.005 to about 5 millimeters.

Porous asbestos diaphragms which may be treated with dispersions of the present invention include any of those which are employed in commercial diaphragm cells. These include diaphragms of chrysotile, crocidolite and anthophyllite asbestos fibers. Also included are porous asbestos diaphragms which have been modified by the incorporation of polymeric materials such as described in U.S. Pat. Nos. 2,860,100; 3,694,281; 3,928,166; and 3,980,613 previously cited, which will be improved by the process of the present invention.

The method of the present invention may also be employed to treat asbestos diaphragms which have been modified by the incorporation of polymers of fluorinated hydrocarbons. Examples of suitable fluorinated hydrocarbon include polytetrafluoroethylene, fluorinated ethylene-propylene (FEP), polychlorotrifluoroethylene, polyvinyl fluoride, polyvinylidene fluoride and copolymers of ethylene-chlorotrifluoroethylene.

The mole ratio of magnesium to silicon is determined from the emperical formula for known compositions. Sepiolite, whose formula is $H_4Mg_2Si_3O_{10}\cdot nH_2O$ has an Mg to Si mole ratio of 1:1.5. Where the silicates are formed in situ, the mole ratios can be determined from the amounts of the components used.

In addition to magnesium-containing silicate, the method of the present invention may employ other alkaline earth metal-containing silicates such as calcium-containing silicates, strontium-containing silicates or barium-containing silicates whose mole ratio of alkaline earth metal to silicon is no greater than about 1:1.

Where the alkaline earth-containing silicate is produced by the interaction of a silica-containing material with an alkaline earth metal salt, suitable salts include, for example, calcium oxide or strontium oxide, calcium chloride or barium chloride, calcium carbonate or strontium carbonate, barium hydroxide or strontium hydroxide, calcium aluminate, and barium peroxide. Also suitable as alkaline earth metal-containing silicates are mineral compositions having a mole ratio of alkaline earth metal to silicon of no greater than 1:1 including wollastonite, apophylite, and eddingtonite.

It will be understood that silicates containing mixtures of alkaline earth metals can also be employed in the treatment of asbestos diaphragms.

The following examples are presented to further illustrate the invention without any intention of being limited thereby.

EXAMPLE I

A commercial chlorine cell for the electrolysis of sodium chloride (315 grams per liter) employed a porous asbestos diaphragm modified by the incorporation of a polymer of fluorinated hydrocarbon. Measurement of the chlorine gas from the anode compartment showed hydrogen was present in an amount of 3.5 percent by volume, and the catholyte cell liquor produced had a sodium hydroxide concentration of 68 grams per liter. Power consumption per ton of chlorine at 130 kiloamps was found to be 2715 kilo-watt hours. A dispersion was prepared by admixing 50 pounds of sepiolite in 30 gallons of alkaline sodium chlorine brine. The sepiolite, having particle sizes in the range of 0.1 to 5 millimeters, had an analysis indicating oxides of the following elements were present as percent by weight: Si 79.1; Mg 9.3; K 4.8; Ca 4.8; Al 1.4 and Fe 1.4. The sepiolite was dispersed in the brine using a stirrer. To the diaphragm cell was added 3 gallons of the dispersion in a ten minute period. The addition was repeated hourly for four hours until 12 gallons of the dispersion had been added to the cell.

The following day, four additional batches of the dispersion were added to the cell, each of the 5 gallon batches were added in a ten minute period. Within 48 hours, the hydrogen content of the chlorine gas had been reduced to 0.1 percent.

Catholyte liquor containing 122 grams per liter of sodium hydroxide was being produced with the power consumption of the cell at 2595 kilowatt hours per ton of chlorine produced. After a period of 2 weeks the hydrogen content had increased to 1 percent. Ten gallons of the dispersion were added. Within 48 hours the hydrogen level had been reduced to 0.1 percent. Two weeks later 10 gallons of the dispersion were added to the cell. The next day the cell was opened and less than one pound of the dispersion was found on the bottom of the cell, indicating that essentially all of the dispersion had been deposited on the asbestos diaphragm.

This Example shows the effective reduction of the hydrogen level in chlorine gas produced in a cell treated by the method of the present invention. Further, the Example shows improved cell operation resulting in a reduction of the power consumption from 2715 kilowatt hours to 2595 kilowatt hours while increasing the sodium hydroxide concentrate in the cell liquor.

EXAMPLES II–V

The effect of the method of the present invention on cell operating efficiency was determined in 4 commercial chlorine cells having asbestos diaphragms modified with a fluorocarbon polymer. Samples of chlorine gas and cell liquor were analyzed and the current efficiency determined for each of the cells prior to the treatment. A dispersion was prepared by adding 25 pounds of sepiolite to 15 gallons of alkaline brine. A batch of 15 gallons was added to each of the cells through an opening in the anode compartment, the entire batch being added at one time. The cells were operated for 3 days and the product analysis repeated and the current efficiencies determined. Chlorine gas was analyzed in a gas chromatograph. The results are presented in Table 1 below.

TABLE I

| EVALUATION DATA BEFORE DOPING CELLS WITH SEPIOLITE | | | | | | | | | | | |
|---|---|---|---|---|---|---|---|---|---|---|---|
| | | CELL LIQUOR | | | | | | | | | |
| BRINE FLOW (GPM) | HEAD LEVEL (INCHES) | NaOH (GPL) | NaCl (GPL) | $NaClO_3$ (GPL) | $NaClO_3$ lbs/1000lbs. NaOH | CHLORINE GAS $Cl_2$% | $H_2$% | $O_2$% | $CO_2$% | $N_2$% | C. E. % |
| 10 | 3.5 | 93 | 205 | .56 | 6.02 | 91.72 | 2.9 | 2.95 | .79 | 1.64 | 93.4 |
| 5 | 4.5 | 180 | 146 | .45 | 2.50 | 90.94 | 1.3 | 3.96 | .69 | 3.11 | 92.9 |
| 8.5 | 3 | 108 | 181 | .19 | 1.76 | 95.02 | 1.0 | 1.66 | .64 | 1.68 | 97.0 |
| 7.5 | 4 | 122 | 173 | .21 | 1.72 | 94.68 | 1.7 | 1.84 | .54 | 1.24 | 96.7 |
| EVALUATION DATA AFTER DOPING CELLS WITH SEPIOLITE | | | | | | | | | | | |
| | | CELL LIQUOR | | | | | | | | | |
| BRINE FLOW (GPM) | HEAD LEVEL (INCHES) | NaOH (GPL) | NaCl (GPL) | $NaClO_3$ (GPL) | $NaClO_3$ lbs/1000lbs. NaOH | CHLORINE GAS $Cl_2$% | $H_2$% | $O_2$% | $CO_2$% | $N_2$% | C. E. % |
| 7 | 6.5 | 112 | 185 | .42 | 3.75 | 95.30 | .4 | 2.69 | .60 | 1.01 | 94.7 |
| 5 | 8 | 157 | 155 | .23 | 1.46 | 95.22 | .3 | 2.54 | .82 | 1.12 | 95.15 |
| 7.5 | 2.5 | 118 | 174 | .17 | 1.44 | 97.04 | .3 | 1.12 | .68 | .86 | 97.86 |
| 8 | 5.5 | 114 | 178 | .11 | .96 | 97.89 | .4 | .65 | .32 | .74 | 98.80 |

As shown in Table 1, significant improvements were obtained in cell operation following the treatment by the method of the present invention. In all 4 cells the current efficiency was increased. The caustic concentration of the cell liquor was also increased while the sodium chloride and sodium chlorate were decreased. Analyses of the chlorine gas samples showed substantial reductions in the amounts of hydrogen and oxygen after doping the cells. What is claimed is:

1. A method for electrolyzing an alkali metal chloride brine in an electrolytic cell having an anode compartment containing said alkali metal chloride brine, a cathode compartment, and a porous asbestos diaphragm separating said anode compartment from said cathode compartment which comprises:

(a) feeding particles of a magnesium-containing silicate to said anode compartment to form a dispersion of said magnesium-containing silicate in said alkali metal chloride brine, said magnesium-containing silicate having a mole ratio of magnesium to silicon of no greater than about 1:1, (b) contacting the porous asbestos diaphragm with said dispersion to deposit particles of said magnesium-containing silicate, and (c) conducting electrolysis in said electrolytic cell.

2. The method of claim 1 in which said alkali metal chloride brine is selected from the group consisting of sodium chloride or potassium chloride.

3. The method of claim 2 in which said magnesium-containing silicate is capable of hydration in contact with an aqueous solution of a salt selected from the group consisting of alkali metal chlorides, alkali metal hydroxides and mixtures of alkali metal chlorides and alkali metal hydroxides.

4. The method of claim 3 in which said magnesium-containing silicate is selected from the group consisting of magnesium silicate, sepiolite, meerschaum, palygorskite, attapulgite, augite, talc, and mixtures thereof.

5. The method of claim 4 in which said dispersion contains from about 1 to about 1000 grams per liter of said magnesium-containing silicate.

6. The method of claim 4 in which said dispersion is present in said anode compartment in amounts of from about 0.1 to about 10 percent by volume of the anolyte in said anode compartment.

7. The method of claim 6 in which said magnesium-containing silicate is selected from the group consisting of magnesium silicates, sepiolites, meerschaums, and mixtures thereof.

8. The method of claim 7 in which said alkali metal chloride brine is sodium chloride.

9. The method of claim 8 in which said magnesium-containing silicates are sepiolites.

10. A method for electrolyzing an alkali metal chloride brine in an electrolytic cell having an anode compartment, a cathode compartment, and a porous asbestos diaphragm separating said anode compartment from said cathode compartment which comprises:

(a) adding to said alkali metal chloride brine particles of a magnesium-containing silicate to form a dispersion of said magnesium-containing silicate in said brine, said magnesium-containing silicate having a mole ratio of magnesium to silicon of no greater than about 1:1, (b) feeding said dispersion to said anode compartment, (c) contacting said porous asbestos diaphragm with said dispersion to deposit particles of said magnesium-containing silicate, and (d) conducting electrolysis in said electrolytic cell.

11. A method for electrolyzing an alkali metal chloride brine in which an electrolytic cell having an anode compartment, a cathode compartment, and a porous asbestos diaphragm separating said anode compartment from said cathode compartment which comprises:

(a) adding to said alkali metal chloride brine a silica-containing compound and a magnesium-containing compound to form a dispersion of a magnesium-containing silicate, said magnesium-containing silicate having a mole ratio of magnesium to silicon of no greater than about 1:1, (b) feeding said dispersion to said anode compartment, (c) contacting said porous asbestos diaphragm with said dispersion to deposit particles of said magnesium-containing silicate, and (d) conducting electrolysis in said electrolytic cell.

12. The method of claim 11 in which said magnesium compound is selected from the group consisting of magnesia, magnesium acetate, magnesium aluminate, magnesium carbonate, magnesium chloride, magnesium hydroxide, magnesium oxide, magnesium peroxide, magnesite, periclase and dolomite.

13. The method of claim 12 in which said silica-containing compound is selected from the group consisting of silica, sand, quartz, chalcedony, cristobalite and tripolite.

14. A method for electrolyzing an alkali metal chloride brine in an electrolytic cell having an anode compartment containing said alkali metal chloride brine, a cathode compartment and a porous asbestos diaphragm separating said anode compartment from said cathode compartment which comprises:

(a) feeding to said anode compartment particles of a magnesium-containing silicate selected from the group consisting of sepiolites and meerschaum to form a dispersion in said alkali metal chloride brine, (b) contacting said porous asbestos diaphragm with said dispersion to deposit particles of said magnesium-containing silicate, and (c) conducting electrolysis in said electrolytic cell.

15. A method for electrolyzing an alkali metal chloride brine in an electrolytic cell having an anode compartment, a cathode compartment, and a porous asbestos diaphragm separating said anode compartment from said cathode compartment which comprises:

(a) adding to said alkali metal chloride brine particles of an alkaline earth metal-containing silicate to form a dispersion of said silicate in said brine, said alkaline earth metal-containing silicate having a mole ratio of alkaline earth metal to silicon of no greater than about 1:1, (b) feeding said dispersion to said anode compartment, (c) contacting said porous asbestos diaphragm with said dispersion to deposit particles of said alkaline earth metal-containing silicate, and (d) conducting electrolysis in said electrolytic cell.

* * * * *